United States Patent [19]

Faber

[11] Patent Number: 4,708,530

[45] Date of Patent: Nov. 24, 1987

[54] CONCRETE FOUNDATION PILE AND DEVICE FOR DRIVING THE SAME INTO THE GROUND

[76] Inventor: Pieter Faber, No. 19, De Meute, 8312 BH Creil, Netherlands

[21] Appl. No.: 918,702

[22] Filed: Oct. 14, 1986

Related U.S. Application Data

[63] Continuation of Ser. No. 605,172, Apr. 30, 1984, abandoned.

[30] Foreign Application Priority Data

May 3, 1983 [NL] Netherlands ..... 8301556

[51] Int. Cl.[4] ..... E02D 5/10; E02D 5/14; E02D 5/30; E02D 7/30

[52] U.S. Cl. ..... 405/252; 405/245; 405/253; 405/256

[58] Field of Search ..... 405/232, 233, 235, 236, 405/239, 241, 240, 242, 245, 246, 247, 249, 250–254, 256; 52/157; 173/128–133

[56] References Cited

U.S. PATENT DOCUMENTS

| | | | |
|---|---|---|---|
| 795,660 | 7/1905 | Stanford | 405/253 X |
| 1,570,404 | 1/1926 | Rotinoff | 405/254 X |
| 1,898,397 | 2/1933 | Rotinoff | 405/245 |
| 2,342,243 | 2/1944 | Brizay | 405/252 |
| 3,248,888 | 5/1966 | Williams | 405/252 X |
| 3,261,412 | 7/1966 | Lob | 405/253 X |
| 4,132,082 | 1/1979 | Merjan | 405/253 |
| 4,239,419 | 12/1980 | Gillen | 405/256 X |

FOREIGN PATENT DOCUMENTS

| | | | |
|---|---|---|---|
| 1156711 | 10/1963 | Fed. Rep. of Germany . | |
| 1157161 | 11/1963 | Fed. Rep. of Germany . | |
| 782050 | 5/1935 | France . | |
| 843499 | 7/1939 | France . | |
| 973059 | 2/1951 | France . | |
| 1528811 | 6/1968 | France . | |
| 2427187 | 12/1979 | France . | |
| 40810 | 1/1937 | Netherlands . | |
| 88487 | 1/1958 | Netherlands . | |
| 91927 | 3/1959 | Netherlands . | |
| 26495 | of 1907 | United Kingdom | 405/256 |
| 783624 | 12/1927 | United Kingdom . | |
| 731262 | 6/1955 | United Kingdom | 405/256 |
| 281148 | 9/1957 | United Kingdom . | |
| 849413 | 9/1960 | United Kingdom | 405/253 |
| 942565 | 11/1963 | United Kingdom | 405/252 |
| 2062073 | 5/1981 | United Kingdom | 405/256 |

*Primary Examiner*—Nancy J. Stodola
*Attorney, Agent, or Firm*—Birch, Stewart, Kolasch and Birch

[57] ABSTRACT

A concrete foundation pile and a device for driving the pile into the ground. The pile is provided with an outer surface having a screw thread element extending over a considerable part thereof, and a cavity extending from an opposite end of the pile forming an internal engaging surface extending over the part of the pile over which the screw thread element extends. A rotational driving force is transferred over said internal engaging surface substantially along the full length over which the screw thread element extends.

22 Claims, 20 Drawing Figures

FIG. 1
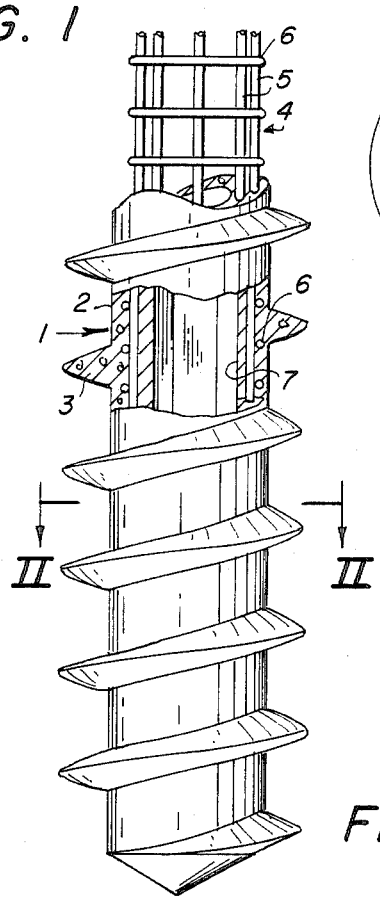
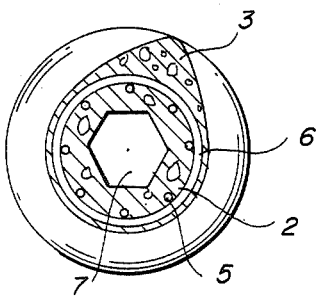
FIG. 2
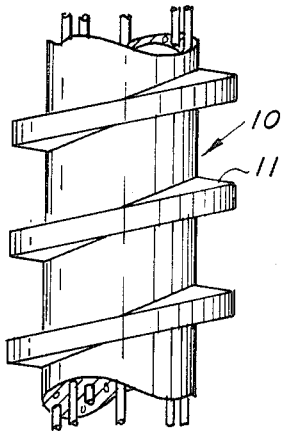
FIG. 3
FIG. 5
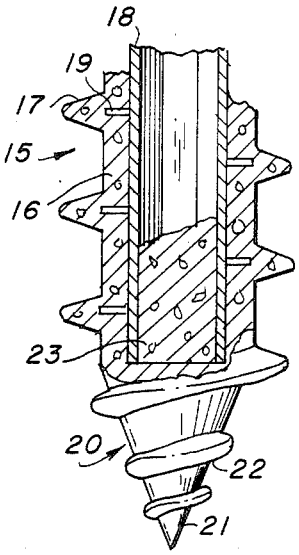
FIG. 4
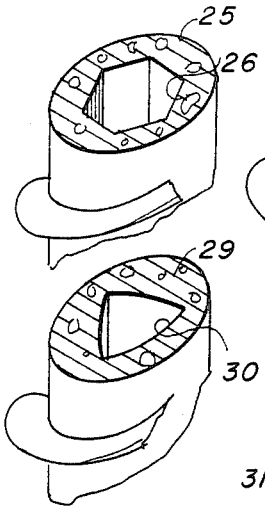
FIG. 7
FIG. 6
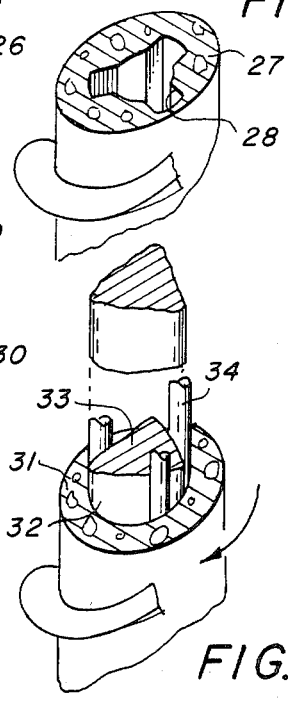
FIG. 8

FIG. 9
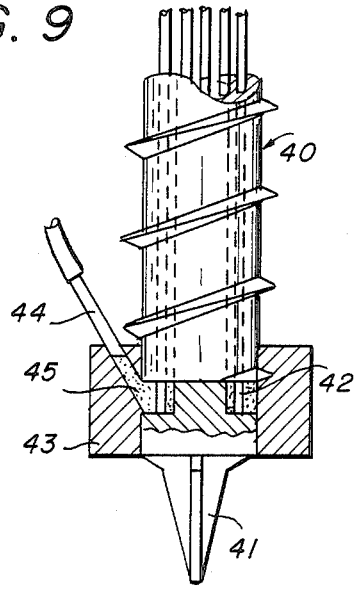
FIG. 10
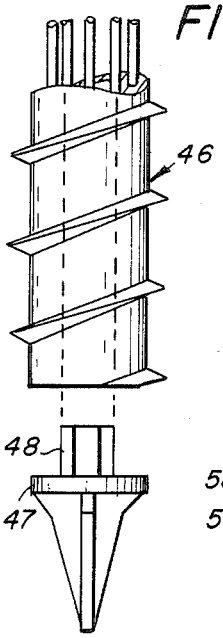
FIG. 12
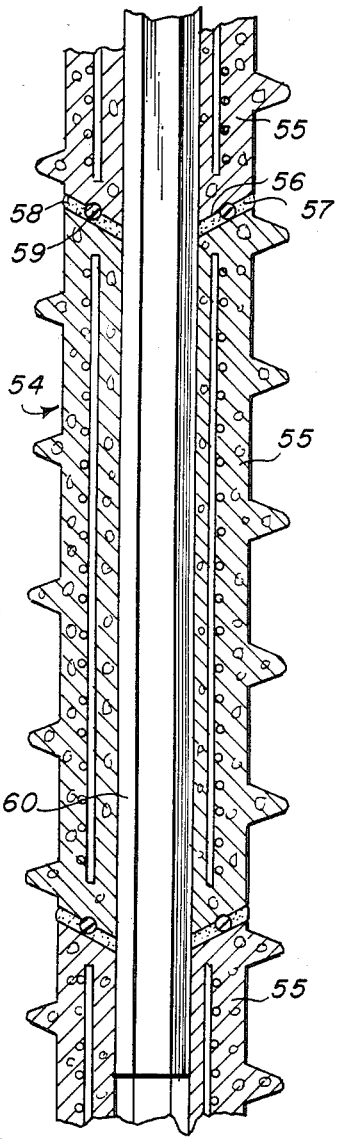
FIG. 13
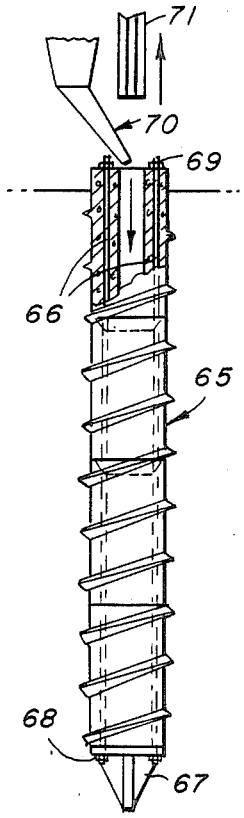
FIG. 11
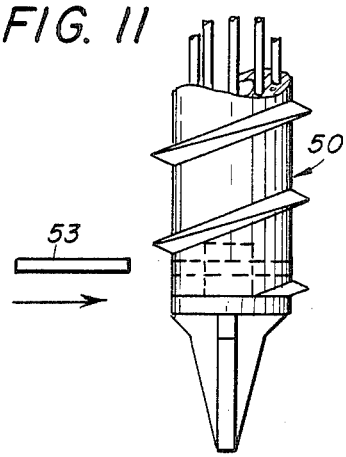
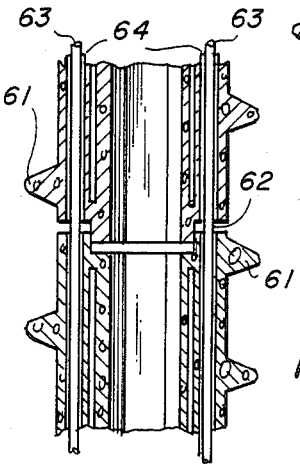
FIG. 14

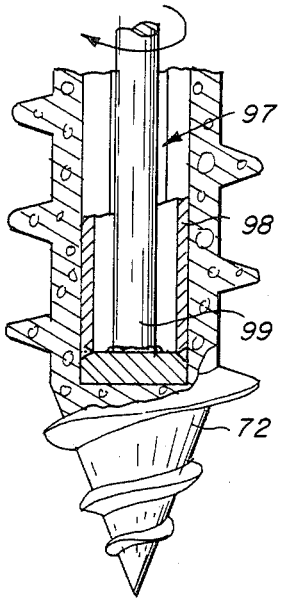
FIG. 16
FIG. 15
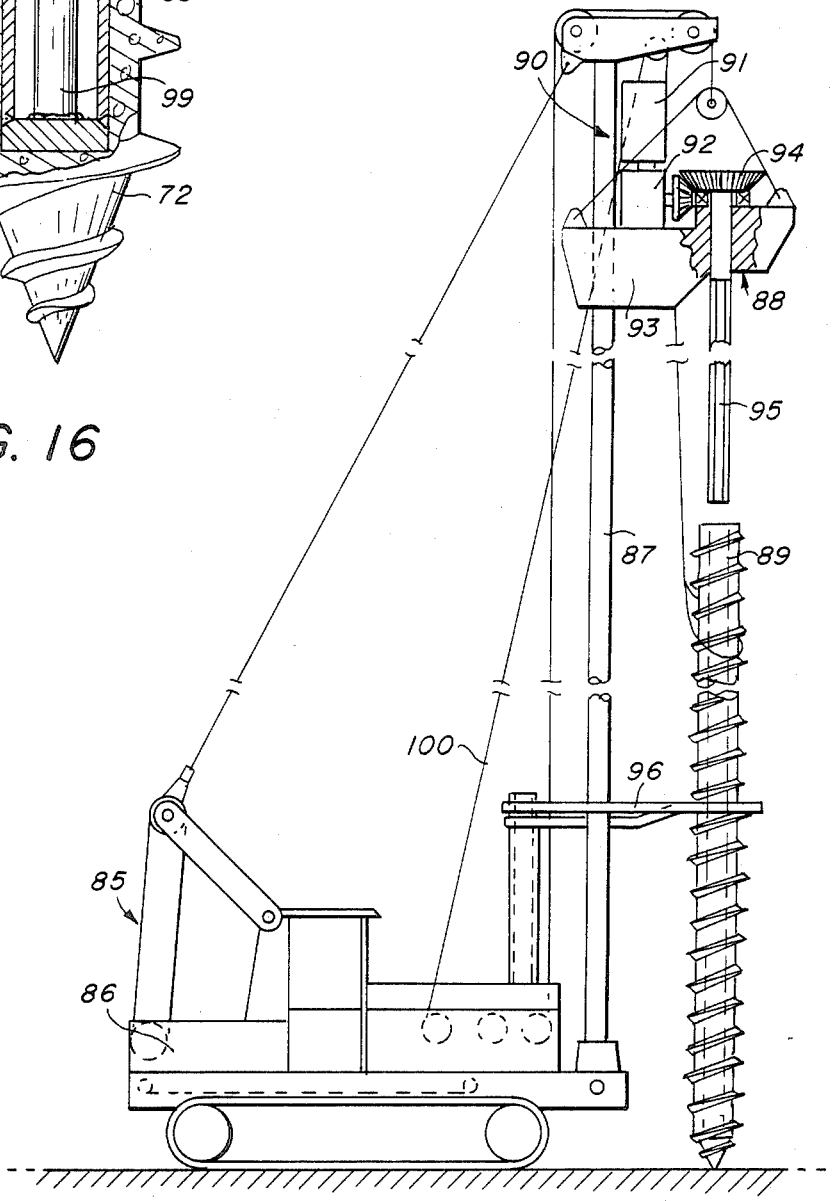

CONCRETE FOUNDATION PILE AND DEVICE FOR DRIVING THE SAME INTO THE GROUND

This application is a continuation of application Ser. No. 605,172, filed on Apr. 30, 1984, now abandoned.

The invention relates to a concrete foundation pile comprising an elongate body, a screwthread element extending helically at least along a part of the outer surface of the body near the end thereof, a cavity extending at least over a considerable part of the length of the body and coaxial therewith and an engaging surface in the cavity for transferring a couple to the body.

Such a foundation pile is known from French patent specification No. 843,499. This known foundation pile is driven into the ground by a rotatably driven rod-shaped element that engages in the cavity near the end of the pile. The screwthread element is also arranged near the end of the pile. In order to avoid overloading of the pile while driving the same into the ground, water is supplied by a central tube through the rod-shaped element, which flushes the ground away near the tip of the pile.

Such a pile has the advantage over generally known concrete ram piles because in built-up areas no noise hindrance is produced nor are vibrations developed in the ground which may cause damage to existing buildings. The disadvantage of this known pile however is, that by flushing away the ground while driving in the pile, the ground is severely disturbed and in particular weakened so that the load bearing capacity of the pile is unfavourably influenced and moreover the load bearing capacity of the pile is unknown.

The object of the invention is to provide a concrete foundation pile of the kind set forth above, that can be driven into the ground without causing a hindrance to the surrounding area and that can be driven into the ground without flushing.

This object is obtained by a foundation pile according to the invention in that the screwthread element extends over a considerable part of the length of the pile and the engaging surface consists of the lower end surface of the cavity in mainly this part of the pile, the cavity having a substantially constant cross-section. When driving the pile in, the rotation force can therefore be applied to the pile over the total length of the cavity. The total couple can thus become very large without the danger of rupturing the pile by applying an excessive torsional force. So, the foundation pile according to the invention can be used in hard and heavy ground.

According to the invention a favorable shape of the cross-section of the cavity is a regular hexagonal one. This cross-sectional shape offers good possibilities for application of a torsional force while nevertheless the tensional stress in the concrete remains limited.

The screwthread element can be formed by a helical recess in the outer surface of the elongate body. Preferably the screwthread element consists of a helical ridge being integral with the body and extending over substantially the total length of the body. Herewith the thickness and the profile of the pile are such that a minimal friction developes while driving in the pile. Moreover through the protruding screwthread element it is achieved that the load bearing capacity of the pile as a consequence of friction in the ground gets a more favourable value.

In order to enable the positioning of the pile in the ground sufficiently accurate on the exact spot, according to the invention the pile is preferably provided at its lower end with a drilling point. This drilling point can in a suitable way be made from metal. The quality demands of the drilling point are limited because it is connected to the pile, and therefore is only used once. Suitable material for the drilling point is, for instance, cast iron.

According to a further development of the invention, the foundation pile consists of a number of pile sections lengthwise arranged with the end surfaces one against the other. These pile sections, for instance, each have a length of 1.5 to 2 m and are as it were "threaded" to the rod-shaped element and thus can, without being connected, been driven into the ground as a single unit. Since a foundation pile is only subjected to compressive loads, in most applications, the composite pile will have the same properties as a pile in one piece.

According to a preferred embodiment the pile sections are provided on their end surfaces with co-operating centering surfaces. In this way the pile sections remain well positioned against one another with their end surfaces, even after a long period of time and under the influence of setting of the ground.

According to a further aspect of the invention, a sealing means such as an "O"-ring is provided between the end surfaces of each of two pile sections arranged against each other. This seals off the central cavity relative to the outside and avoids penetration of ground water into the cavity. Therefore, before filling the cavity up with concrete, no water will have to be evacuated from the cavity.

According to another aspect of the invention the pile sections of a composite pile comprise channels extending longitudinally in each of the pile sections, through which channel tension elements, such as tension rods, extend to pull the pile parts against each other, said tension elements at least engaging the end surfaces of the composite pile. In this way, piles of a suitable length can be composed on the building site out of a plurality of pile sections. The tension elements can be tensioned after driving in the pile, so that a foundation pile with the favorable properties of a prestressed concrete pile is obtained.

When the channels have a large clearance with respect to the tension elements the channels can be injected with concrete so that the tension force is evenly spread over the length of the pile, for instance, after the composite pile has been driven into the ground and tensioned. Consequently it is also possible to shorten the pile head i.e. decapitation for bringing the pile on a desired level and thereby treeing the reinforcements thereof. The prestress properties of the rest of the pile is completely maintained.

The invention also relates to and provides a pile section for forming with at least one similar pile section a foundation pile according to the invention, described above.

The invention furthermore relates to and provides a device for driving a pile as described above into the ground. According to the invention this device comprises a frame a, rotation drive means connected to said frame, said rotation drive means comprising a rod-shaped element with a cross-section complementary with the cross-section of the cavity of the foundation pile to be driven in and having a length at least equal to the length of the cavity, the stiffness in torsion of the rod-shaped element being larger than that of the pile to be driven in. Because of the higher torsion-stiffness of the rod-shaped element, the rod-shaped element drivingly engages the pile over the total length of the cavity. By this a good stress-distribution in the pile is obtained when driving the same into the ground, so that in a reliable way the pile is not damaged. The torsion-stiffness of the rod-shaped element is chosen so high, that during the driving of the pile the developed torsional strain in the pile remains within acceptable limits.

According to a further development of the device according to the invention the rod-shaped element comprises a cavity engaging tube element and an inner elongate element connected to the driving means, said inner elongate element at least at its lower end drivingly engaging the outer tube element. The rotation drive means therefore engage the inner elongate element such that the rotation force is at least introduced at the lower end of the outer tube element. Since by driving in the foundation pile the highest friction develops at the tip of the pile, a good power transferral is realized. Only those torsional forces that are developed as a reaction to the friction on the outer surface of the pile are exerted on the elongate body of the foundation pile.

Resilient elements such as rubber elements may be placed between the outer tube and the inner elongate element for an even distribution of one or more power transferring connections.

According to another embodiment of the invention the rod-shaped elements can be provided with a drilling point. This rod-shaped element can then be used for driving foundation piles with a throughgoing cavity into the ground. While driving in the pile the drilling point protrudes under the pile. The use of a specific embodiment of the foundation pile depends, as described above, on conditions such as the type of soil and the length of the foundation pile. The last mentioned embodiment can, for instance, be used for driving a pile into a layer of sand. Driving a pile into a dense sand layer prevents an early penetration of water into the cavity of the pile wherein the cavity can subsequently be filled without disadvantageous effects.

According to a further development of the device according to the invention, the drilling point is rotatably connected to the rod-shaped element and drive means are provided for rotating the drilling point relative to the rod-shaped element. The drilling point thus can predrill the hole for the pile.

The drive means can favorably comprise a drilling rod engaging the drilling point and extending through the rod-shaped element. By rotating the drilling point in the opposite direction with respect to the foundation pile, the resulting couple on the driving deivce can be strongly reduced or even be totally eliminated.

When the drilling point comprises extendable parts according to the invention, a larger diameter can be predrilled than the diameter of the central cavity. The last mentioned embodiment of the invention of the foundation pile has a throughgoing cavity which can also be applied in cases wherein there is danger of groundwater penetrating into the cavity when the rod-shaped element is taken out. According to the invention the rod-shaped element is provided with a conduit ending or near the point, and the device further comprises supply means for supplying the channel with a curable mixture, such a quick curing concrete or a synthetic resin. This mixture forms a sealing impermeable plug so that ground water cannot enter the cavity anymore.

The device according to the invention can in a very favourable way include a rod-shaped element comprising a number of elements coupled to one another. Foundation piles can be driven into the ground in such a way, that pile sections are added one after the other. At the same time with the adding of a new pile section the rod-shaped element is extended with an element section. Thus it is possible to drive in piles of any length in a height restricted space such as a cellar of an existing building, the foundation of which has to be strengthened.

The invention will be described hereinafter more fully with reference to the accompanying drawing.

FIG. 1 is a partly broken away and partly sectional side view of a part of a foundation pile according to the invention.

FIG. 2 is a cross-section according to line II—II in FIG. 1.

FIG. 3 is a view of a part of another embodiment of a foundation pile according to the invention.

FIG. 4 is a partly sectioned side view of the lower end of again another embodiment of the foundation pile according to the invention.

FIGS. 5–8 show possible cross-sections of the internal cavity of the foundation pile.

FIGS. 9–11 show different ways of the connecting of drilling points.

FIG. 12 shows a partly longitudinal section of a foundation pile composed of a number of pile sections.

FIG. 13 shows in a partial sectioned side view another embodiment of a composite pile.

FIG. 14 shows a partial longitudinal section of again another composite pile according to the invention.

FIG. 15 shows schematically a device for driving a foundation pile according to the invention into the ground.

FIG. 16 is a partly broken away side view of an embodiment of a rod-shaped element used for driving a foundation pile according to the invention into the ground.

Figure 17:
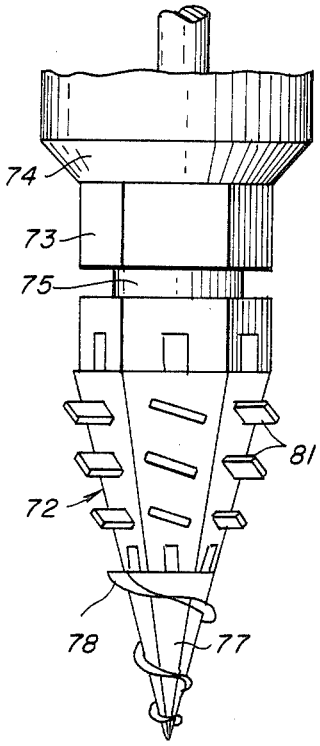
FIGS. 17 and 18 show an embodiment of a drilling point of the rod-shaped element, in retracted and extended state, respectively.

The pile 1 comprises an elongate body 2 with a mainly cylindrical outer surface. On the cylindrical outer surface extends helically a screwthread element 3. This screwthread element 3 is a helical ridge integral with the body 2. The pile 1 comprises reinforcement 4 formed by a number of axial reinforcement bars 5 and tangential reinforcement 6 at regular intervals. The material of the pile consists further of concrete. In order to transfer a couple to the pile, the pile is provided with an engaging surface 7 shaped as a cavity extending over at least a considerable part of the length of the body. The way a couple is transferred to the pile will be described furtheron.

As clearly becomes apparent from FIG. 2 the tangential reinforcement 6 is capable of compensating the tension forces in the concrete of the pile when a couple is exerted on the wall of the cavity 7. Because the couple can engage evenly over the total length of the cavity, as will be explained, the tangential reinforcement is not necessary in all cases.

The screwthread element 3 of the pile 1 has a conventional triangular cross-section. As is shown in FIG. 3 for the pile 10, the screwthread can, however, also be a buttress screwthread. It is evident that other screwthread shapes can be used. The screwthread shape ultimately chosen depends upon other parameters of the screwthread, such as pitch, height, choice of single or multiple screwthread an upon the application aimed at. So, a relative high screwthread with a small pitch can be chosen in a case where the foundation pile has to mainly rely on adhesively for its bearing capacities. If the pile has to bear upon a bearing ground layer on a lower lever in the ground, the screwthread has to have a shape which is needed to obtain the prescribed screw-action.

However, generally a pile will be used wherein the screwthread turns of which will be positioned against one another as is the case of a screw bolt.

The pile 15 shown in FIG. 4 has on the cylindrical body 16 a screwthread 17 with a rounded top. For reinforcing the pile 15 a tube 18 is used, on the outer surface of which reinforcement strips 19 have been welded. The engagement cavity of the pile 15 is so formed by the reinforcement tube 18. A screw point 20 is casted to the lower end of the pile 15. This screw point has an acute top angle so that the pile 15 screws itself into the ground. The screwthread 22 runs almost to the extreme point.

The cavity in the foundation pile can have different shapes. FIG. 5 shows a preferred embodiment. The pile 25 as shown has a cavity 26 with a regular hexagonal cross-section.

The pile 27 shown in FIG. 6 has a cavity 28 with a cross-section looking like splines. In exerting a couple on the walls of the cavity 28 mostly shearing forces are developed in the only concrete. Tension forces which concrete can restrictedly absorb are mostly avoided by this or a similar embodiment. The cavity 30 of the pile 29 in FIG. 7 has a fundamental triangular cross-section with rounded sides and corners. With such a well rounded cross-sectional shape of the cavity the distribution of forces remains uniform. Thus, a relatively large couple can be applied before unacceptable stresses occur.

Except for angular cross-sections shown in the preceding Figures, the foundation pile according to the invention can have a circular cross-section as well. Such a pile 31 is shown in FIG. 8. The cross-section 32 here is circular. For transferring the couple a tool has to be used that transfers the couple to the wall of the cavity by friction. Such a tool can, for instance, comprise a driving rod 33 with a non-circular cross-section and a number of rubber strands 34. When the couple is applied to the driving rod 33, the rubber strands 34 are clamped in between the wedges formed between the walls of the rod 33 and the cavity 32, so that the desired couple can be transferred by friction.

In order to center the foundation pile while driving the same into the ground and thus obtaining an accurate positioning, the pile can be provided with a drilling point. In FIG. 9 a possible way of applying such a drilling point 41 is shown. This drilling point 41 is made of metal and welded to the reinforcement 42 of the pile 40. After welding the end of the pile 40 together with the drilling point 41 the welding site of 40 and are taken up in a mold 43 and the remaining space 45 is filled up with concrete through a supply conduit 44. After curing the point 41 forms an integral part of the pile.

Depending on the application it is not always necessary to connect the drilling point to the reinforcement. As is shown in FIG. 10 a drilling point 47 can be used with the pile 46, which drilling point 47 has a shoulder 48 with a profile that fits in the cavity of the pile 46. The drilling point 47 can, for instance with an adhesive, be connected with the pile 46. In this respect it must be noted that for the fixation of the part 47 with respect to the pile generally no high demands have to be made, as the drilling point is always pushed into contact with the pile, when driving the pile into the ground. The connection only has to be such that the couple needed for the drilling action can be transferred through this connection. In many cases it will be sufficient when the drilling point as shown in FIG. 10 is provided with a shoulder such as 48 which fits into a recess of the pile.

As is shown in FIG. 11 for pile 50, the drilling point 51 can be secured by means of a key 53 placed in a cross bore 52.

The foundation pile according to the invention as shown in FIG. 12 consists of a number of pile sections 55 lengthwise arranged with their end surfaces 56, 57 against one another. It is shown that through the central cavity of the pile 54 composed of the pile sections 55 a rod-shaped element 60 partly extends. The pile sections 55 are held together by this rod-shaped element 60 and are driven into the ground as a single unit. The pile sections 55 can first be "threaded" onto the rod-shaped element 60 and driven into the ground in one stroke. It is also possible to first drive a lower pile section 55 into the ground, then to withdraw the rod-shaped element 60, to place a second pile section 55 on top of the lower pile section 55 and then to insert the rod-shaped element through the aligned central cavity of these pile sections 55, after which the pile now consisting of two pile sections is driven further in the ground. Subsequently in the same way a next pile section 55 can be added, etc. When placing the pile sections 55 on top of each other a concrete adhesive 58 is applied between the end surfaces 56, 57. FIG. 12 furthermore shows that sealing means such as a rubber "O"-ring can be received between the end surfaces. This "O"-ring seals the central cavity relative to the outside, so that no groundwater can flow into the central cavity between the end surfaces. The concrete adhesive 58 cures after the pile has been driven into the ground, so that a closed cavity is formed. This cavity can afterwards be filled as described earlier.

The end surfaces 56, 57 are complementary conically shaped, so that they co-operate as centering surfaces. In the embodiment of FIG. 14 two pile sections 61 are provided with co-operating cylindrical centering surfaces 62.

According to another aspect of the invention, synthetic resinous tubes 64 are taken up in the pile sections 61 creating channels extending along the length of each pile section 61. Through these channels tension elements 63 are provided for pulling the pile sections 61 against one another.

FIG. 13 shows a pile 64 composed of pile sections tensioned against each other by tension elements 66. These tension elements 66 are at their ends provided with screwthread, at the lower end of which nuts 68 and at the upper ends of which nuts 69 are screwedd. The nuts 68 bear against a flange of a tip 67 forming an integral part of the pile 67 as described before. The pile 65 being tensioned in this way by tension elements 66 to form a single unit can be used in the same way as a monolithic pile, as described before. After the rod-shaped element 71 has been removed, the central cavity can be filled by concrete supply means 70. This preferably takes place after the tension elements 66 by means of nuts 69 are tensioned. The pile 65 obtains herewith the properties of a prestressed pile.

When the channels in the pile sections have a large clearance with respect to the tension elements 66 this clearance can after the tensioning of the tension elements be filled with concrete. After curing of the concrete the nuts 69 can in a conventional way be released, without loosing the prestress properties of the pile 65. If desired, the pile 65 can be decapitated without disadvantageous results.

FIG. 15 schematically shows a device 85 for driving the pile 89 into the ground. This device 85 comprises a mobile frame 86 on which a rising jib 87 is mounted. By means of a cable 100 a drive head 88 is connected to the device 85. The driving head 88 can slide up and down over the jib 87. The driving head 88 comprises rotation drive means 90. These rotation drive means comprise a motor 91, for instance an electromotor or a hydraulic motor, a gear box 92 and a transmission 94. The outgoing shaft of the transmission 94 is connected to a rod-shaped element 95 that can engage in the cavity of the pile 88. The length of the rod-shaped element 95 is chosen such that this element can reach to the lower end of the cavity of the pile 89. According to the invention the torsion-stiffness of the rod-shaped element 95 is larger than that of the pile 89. If now a couple of the rotation drive means, by means of the rod-shaped element 95 is transferred to the pile 89, the rod 95 shall over its total length engage in the cavity of the pile.

The device 85 exerts a downward directed force to the pile 89 by a block 93 of the driving head 88. This block 93 together with the parts of the rotation drive means 90 have a sufficient weight to obtain a good screw driving action of the pile 89 when the pile is being rotated. When the jib 87 is longer than the length of the pile 89 and the rod 95 together, the pile 89 can first be stood up before the rod 95 is inserted into the cavity thereof. The pile 89 can temporarily be supported by the support 96. However, when long piles have to be driven into the ground, the driving head 88 can be constructed in such a way that the rod 95 thereof can swing, so that the rod can be inserted into the cavity while the pile is still lying on the ground or in a sloping position in between.

The rod-shaped element 97 can be hollow or massive and can be multipart as shown in FIG. 16. The rod-shaped element 97 includes an outer tube 98 and an inner rod 99 received therein. The lower end of the inner rod 99 is connected to the outer tube 98. The inner rod 99 is connected to the rotation drive means such that the rotation couple is applied directly to the bottom of the pile. Since by driving in the pile a considerable part of the friction occurs at the tip of the pile, a good transmission force is herewith obtained. Torsional stresses developed in the body of the pile can thus be limited. It is possible to provide force transferring elements such as rubber elements between the inner rod 99 and the outer tube 98. By a suitable construction it is possible to reduce torsion of the outer tube 98 and consequently of the pile, to a minimum. A drill point 72 may be attached to the bottom of the pile.

In case a pile according to the invention has to be driven into such heavy ground that danger arises of damaging the pile, a hole can be drilled with a diameter not larger than the diameter of the cylindrical body before driving the pile into the ground.

Figure 18:
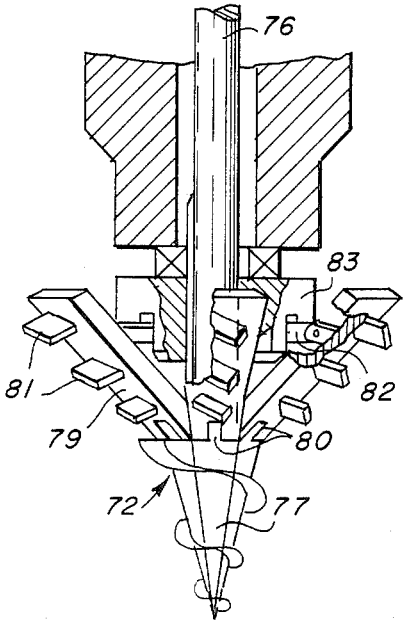

For this predrilling the rod-shaped element can at its lower end be provided with a drilling point 72 as shown in FIG. 17 and 18, said drilling point is rotatably connected to the rod-shaped element 73 by means of a bearing 75. When driving in the pile 74, the drilling point 72 protrudes under the pile 74. By driving the drilling point 72 by means of a central drilling rod extending through the rod-shaped element 73, the ground beneath the pile is loosened and pressed aside. The end part 77 of the drilling point is, as shown, provided with a drilling helix 78 while the side planes further are provided with sloping blades 81. As shown in FIG. 18 parts 79 of the drilling point 72 can be extended by drawing up the drilling rod 76 with respect to the rod-shaped element 73. The wings 79 are at their lower ends pivotally connected to the end part 77 of the point 72. Each of the wings 79 is further swingably connected to the body 83 of the drilling point 72 by means of an arm 82.

In the extended position of the drilling point 72 as shown in FIG. 18, it has a larger active diameter than in the position shown in FIG. 17.

It is advantageous if the wings of the drilling point can be moved pulsatingly. The soil will be readily pressed aside under the pile and because of that, will be compressed.

The drilling point 72 is preferably driven in a direction opposite to the direction of rotation of the pile 74. The reaction couples of the drilling point 72 and the pile 74 are consequently opposite to one another, so that the resulting couple exerted on the frame of the driving device can be small or even nil.

After removal of the rod-shaped element the cavity again can be filled with concrete, as described before. Groundwater which possibly seeped in can be removed by putting the cavity under pressure from the uppe side with compressed air. Next the concrete is pumped into the cavity by a concrete pump. Such a concrete pump easily can overcome the pressure of the compressed air which is, for instance, 8 to 10 bar.

Figure 19:
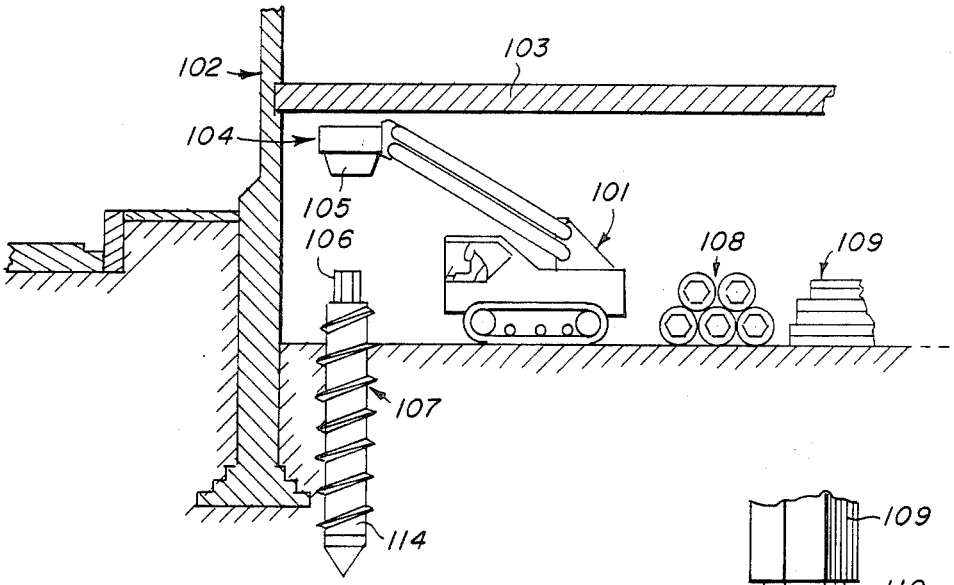
FIG. 19 shows schematically the operation of a device according to the invention for driving a composite pile into the ground.

FIG. 19 shows schematically a device 101 according to the invention, favourably using some aspects of the invention in order to drive a pile 107 into the ground in a restricted space. This restricted space here is a cellar of a building 102 which cellar at its upper side is bounded by the floor 103 of the overlying storey. In case the foundation of the building 102 has to be strengthened by extra piles 107, while these piles cannot be arranged from the outside, for instance because the building is adjacent to a traffic road or another building the device 101 can successfully be used.

Figure 20:
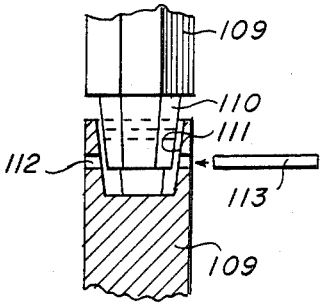
FIG. 20 shows a partly sectioned exploded view of the rod-shaped element as applied with the device as shown in FIG. 19.

According to the invention the rod-shaped element 106 of the device 101 comprises a number sections 109. As shown in FIG. 20 these sections 109 can be coupled together by inserting a protruding coupling part 110 at the bottom side of each section 109 into a recessed coupling part 111 of the section therebelow. The sections 109 are provided with bores 112 which are aligned when the sections are coupled, so that a key 113 can be introduced for fixing the sections 109 to one another. The driving of the pile 107 into the ground takes place as follows. First the lower pile section 114, which may be provided with a point, is driven into the ground. Next, one section 109 of the rod-shaped element is inserted in the central cavity, said section subsequently is brought into engagement with the driving head 105 of the rotating device 104 of the device 101. After the lower pile section 114 is driven into the ground almost to the ground surface, the driving head 105 is taken away from section 109 of the rod-shaped element. Thereafter in the way as shown in FIG. 20, a next section 109 of the rod-shaped element 106 is connected to the first section. A next pile section 108 is slid over this second section. By bringing the driving head 105 again into engagement with the protruding part of the rod-shaped element, the pile 107 now consisting of two sections can again be driven into the ground to the ground surface. Subsequently, a section 109 of the rod-shaped element is connected to the former one and another pile section 108 is added, after which the pile 107 now consisting of three sections 108 is driven further into the ground. This method is repeated until the pile 107 includes the desired number of pile sections 108.

When the available free height is less than the total length of one pile section 108 and one rod section 109, it is possible to slide the rod-shaped element 106 beforehand into the cavity of the pile section 108, whereby for coupling the sections 109 the pile section 108 is first supported at a distance above the pile 107.

The sections 109 can, of course, be provided with self-gripping couplings.

In addition rooms having a restricted height, a device of the kind according to FIG. 19 may also be used in built-up areas. Because a long gib is not present, this device can very easily maneuver and be transported in such an area.

The force to be delivered by the rotation drive means is proportional with the friction exerted on the pile. When the pile has to rely on adhesiveness, the force delivered by the rotation drive means is a good indication of the bearing capacity obtained. When a calculated value of the driving force is attained, the driven pile will have sufficient load bearing capacity.

I claim:

1. A concrete foundation pile comprising:

an elongated body;

a screw thread element extending helically over a considerable part of the length of an outer surface of said body from an end thereof;

and a cavity extending from an opposite end of said body;

said cavity having a non-circular, lengthwise substantially constant cross-section, at least in the part of the pile over which the screw thread element extends, and forming an internal engaging surface extending over the part of the pile over which the screw thread element extends, wherein said internal engaging surface is the wall of the cavity and wherein a rotational driving force is transferred over said internal engaging surface substantially along the full length of the pile over which the screw thread element extends.

2. The foundation pile according to claim 1 wherein said the cross-section is regularly hexagonal.

3. The foundation pile according to claim 1 wherein said screwthread element comprises a helical ridge being integral with said body and extending over substantially the length of said body.

4. The foundation pile according to claim 1 wherein a drilling point is provided at the end of the body.

5. The foundation pile according to claim 4 wherein said drilling point is comprised of metal.

6. The foundation pile according to claim 1 wherein said pile comprises a plurality of pile sections lengthwise arranged provided with end surfaces integrally attached.

7. The foundation pile according to claim 6 wherein said end surfaces comprise co-operating centering surfaces.

8. The foundation pile according to claim 6 wherein a sealing means is provided between said end surfaces.

9. The foundation pile according to claim 8 wherein said sealing means comprises an O-ring.

10. The foundation pile according to claim 6 wherein said pile sections are provided with longitudinally extending channels, wherein channel tension element means engage said end surfaces of said pile.

11. The foundation pile according to claim 10 wherein said channels are provided with a large clearance relative to said tension elements.

12. The foundation pile according to claim 10 wherein said channel tension element comprises a tension rod.

13. The foundation pile according to claim 6 wherein said pile section engages and connects with at least one similar pile section.

14. A device for driving a foundation pile in combination with the foundation pile, according to claim 1 comprising: a frame, a rotation driven means connected to said frame, said rotation drive means further comprising a rod-shaped element having a cross-section complementary with said cross-section of said cavity of said foundation pile and having a length at least equal to said length of said cavity, the stiffness in torsion of said rod-shaped element being larger than that of said pile.

15. The foundation pile according to claim 1, wherein said cross-section is substantially triangular.

16. A device for driving a foundation pile in combination with the foundation pile, wherein the foundation pile comprises:

an elongated body;

a screw thread element extending helically over a considerable part of a length of an outer surface of said body from an end thereof;

and a cavity extending from an opposite end of said body;

said cavity having a non-circular, lengthwise substantially constant cross-section, at least in the part of the pile over which the screw thread element extends, and forming an internal engaging surface extending over the part of the pile over which the screw thread element extends wherein said internal engaging surface is the wall of the cavity and wherein a rotational driving force is transferred over substantially the full length of the pile over which the screw thread element extends;

said device comprising:

a frame, a rotation drive means connected to said frame, said rotation drive means further comprising a rod-shaped element having a cross-section complementary with said cross-section of said cavity of said foundation pile and having a length at least equal to said length of said cavity, the stiffness in torsion of said rod-shaped element being larger than that of said pile, and wherein said rod-shaped element comprises a cavity engaging outer tube element and an inner elongate element connected to said drive means, said inner elongate element at least at its lower end drivingly engaging said outer tube element.

17. The device according to claim 16 wherein a lower end of said rod-shaped element is provided with a drilling point capable of protruding out of a foundation pile provided with a throughgoing cavity.

18. The device according to claim 17 wherein said drilling point is rotatably connected to said rod-shaped element and said drive means is provided for rotating said drilling point relative to said rod-shaped element.

19. The device according to claim 17 wherein said drive means comprises a drilling rod extending through said rod-shaped element and engages said drilling point.

20. The device according to claim 17 wherein said drilling point comprises upwardly extending extendable parts.

21. The device according to claim 17 wherein said rod-shaped element is provided with a conduit ending near said drilling point and is further provided with a supply means for supplying a curable mixture through said conduit.

22. The device according to claim 16 wherein said rod-shaped element comprises a plurality of said elements coupled to one another.

* * * * *